US011344989B2

(12) United States Patent
Gilan et al.

(10) Patent No.: US 11,344,989 B2
(45) Date of Patent: May 31, 2022

(54) ROTATIONAL ABRASIVE MICRO/NANO-FINISHING

(71) Applicants: Aref Azami Gilan, Kermanshah (IR); Abdolhamid Azizi, Ilam (IR); Ali Khoshanjam, Kermanshah (IR)

(72) Inventors: Aref Azami Gilan, Kermanshah (IR); Abdolhamid Azizi, Ilam (IR); Ali Khoshanjam, Kermanshah (IR)

( * ) Notice: Subject to any disclaimer, the term of this patent is extended or adjusted under 35 U.S.C. 154(b) by 712 days.

(21) Appl. No.: 16/271,901

(22) Filed: Feb. 11, 2019

(65) Prior Publication Data

US 2019/0168353 A1 Jun. 6, 2019

(51) Int. Cl.

| | |
|---|---|
| ***B24B 31/10*** | (2006.01) |
| ***B24B 31/02*** | (2006.01) |
| ***B24B 31/104*** | (2006.01) |
| ***B24B 31/108*** | (2006.01) |
| ***B24B 31/00*** | (2006.01) |
| ***B24B 31/14*** | (2006.01) |

(52) U.S. Cl.

CPC ..... *B24B 31/003* (2013.01); *B24B 31/006* (2013.01); *B24B 31/02* (2013.01); *B24B 31/0224* (2013.01); *B24B 31/10* (2013.01); *B24B 31/104* (2013.01); *B24B 31/108* (2013.01); *B24B 31/14* (2013.01)

(58) Field of Classification Search

CPC ..... B24B 5/047; B24B 31/003; B24B 31/02; B24B 31/0212; B24B 31/0224; B24B 31/10; B24B 31/104; B24B 31/108; B24B 31/116; B24B 31/14; B24B 37/044; B24B 57/02

USPC ..... 451/32, 35, 36, 104, 106, 109, 113, 326, 451/327, 328

See application file for complete search history.

(56) References Cited

U.S. PATENT DOCUMENTS

| | | | | |
|---|---|---|---|---|
| 1,946,440 A * | 2/1934 | Herrmann | B24B 31/02 | 451/32 |
| 4,154,290 A * | 5/1979 | Weststrate | B22C 5/085 | 164/404 |
| 4,753,046 A * | 6/1988 | Thonney | B24B 31/03 | 451/32 |
| 4,841,751 A * | 6/1989 | Ricci | D06B 11/0096 | 451/328 |
| 4,976,472 A * | 12/1990 | Kozlov | B02C 15/08 | 241/172 |
| 5,551,779 A * | 9/1996 | Gantner | B01F 9/0001 | 366/217 |
| 5,896,901 A * | 4/1999 | Lacroix | B27L 1/025 | 144/208.9 |

(Continued)

*Primary Examiner* — Eileen P Morgan
(74) *Attorney, Agent, or Firm* — Bajwa IP Law Firm; Haris Zaheer Bajwa

(57) ABSTRACT

A method for outer surface finishing of a workpiece may include coaxially placing the workpiece inside a vessel. The exemplary vessel may include at least one baffle that may radially extend from an inner wall of the vessel toward the outer surface of the workpiece. The exemplary method may further include pouring an abrasive medium inside the vessel, rotating the abrasive medium about the longitudinal axis in a first direction within the vessel relative to the outer surface of the workpiece by rotating the vessel about the longitudinal axis, and concurrently rotating the workpiece within the vessel about the longitudinal axis in a second direction, the second direction being opposite the first direction.

14 Claims, 15 Drawing Sheets

(56) References Cited

U.S. PATENT DOCUMENTS

| | | | | |
|---|---|---|---|---|
| 6,821,191 | B2 * | 11/2004 | Lim | A63B 47/04 241/171 |
| 6,962,522 | B1 * | 11/2005 | Kawasaki | B24B 31/003 451/104 |
| 7,883,396 | B2 * | 2/2011 | Potterfield | B24B 31/073 451/326 |
| 8,932,108 | B2 * | 1/2015 | Ma | B24B 31/023 451/35 |
| 10,166,651 | B2 * | 1/2019 | Tian | B24B 31/064 |
| 10,201,885 | B2 * | 2/2019 | Azami Gilan | B24B 31/108 |
| 10,597,744 | B2 * | 3/2020 | Rostvall | C22C 29/14 |
| 2008/0197223 | A1 * | 8/2008 | Nagao | B02C 17/08 241/175 |
| 2014/0220869 | A1 * | 8/2014 | Tzeng | B24B 31/003 451/113 |
| 2014/0235146 | A1 * | 8/2014 | Mingot | B24B 7/02 451/392 |

* cited by examiner

ROTATIONAL ABRASIVE MICRO/NANO-FINISHING

CROSS REFERENCE TO RELATED APPLICATION

This application is a continuation-in-part of U.S. patent application Ser. No. 15/338,382, filed Oct. 29, 2016, and entitled "ROTATIONAL ABRASIVE MICRO/NANO-FINISHING," which is incorporated herein by reference in its entirety.

TECHNICAL FIELD

The present disclosure generally relates to methods and devices for surface finishing, and particularly to a rotational abrasive nano/micro finishing method and apparatus.

BACKGROUND

There is an ever-growing need for precisely finished surfaces with surface roughness in the order of micro/nanometer or sub-nanometer in different industries, especially high-tech industries including aerospace, military, automotive, medicine industries, etc. Traditional finishing methods may not be capable of delivering such a roughness. In order to overcome various limitations of the traditional finishing processes researchers have developed several advanced finishing processes utilizing abrasives to finish the parts made of difficult-to-machine materials having complex geometrical shapes. Finishing rate, material removal and surface texture are the parameters which can be improved, using the advanced finishing methods.

Some of the advanced finishing methods are rather cost or time inefficient, which give rise to a need for an efficient and relatively low-cost method to provide such a finishing functionality to reach micro/nanometric roughness.

SUMMARY

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

Various exemplary methods and devices are disclosed, and examples may include a rotating abrasive finishing method and apparatus that may be configured to deliver finishing operation in the order of nanometer.

According to one or more exemplary embodiments, the present disclosure is directed to a method for outer surface finishing of a workpiece. The exemplary method may include coaxially placing the workpiece inside a vessel. The exemplary vessel may include at least one baffle that may radially extend from an inner wall of the vessel toward the outer surface of the workpiece. The exemplary method may further include pouring an abrasive medium inside the vessel, rotating the abrasive medium about the longitudinal axis in a first direction within the vessel relative to the outer surface of the workpiece by rotating the vessel about the longitudinal axis, and concurrently rotating the workpiece within the vessel about the longitudinal axis in a second direction, the second direction being opposite the first direction.

In an exemplary embodiment, coaxially placing the workpiece inside the vessel may include placing the workpiece inside the vessel such that the workpiece has a common longitudinal axis with the vessel.

In an exemplary embodiment, pouring the abrasive medium inside the vessel may include pouring the abrasive medium between the inner wall of the vessel and the outer surface of the workpiece, where the abrasive medium may contact the outer surface of the workpiece.

In an exemplary embodiment, coaxially placing the workpiece inside the vessel may further include shaping an outer edge of the baffle adjacent the outer surface of the workpiece such that a shape of the outer edge of the baffle adjacent the outer surface of the workpiece may conform with a shape of the outer surface of the workpiece.

In an exemplary embodiment, coaxially placing the workpiece inside the vessel may further include placing the workpiece inside the vessel such that a horizontal distance between the outer edge of the baffle and the outer surface of the workpiece may be constant along a vertical length of the outer edge of the baffle.

In an exemplary embodiment, rotating the abrasive medium about the longitudinal axis within the vessel may include forcing the abrasive medium to assume a rotational movement about the longitudinal axis by pushing the abrasive medium along a rotational path about the longitudinal axis utilizing the at least one baffle.

In an exemplary embodiment, pouring the abrasive medium inside the vessel may include pouring a mixture of a processing oil and nanoparticles inside the vessel. In an exemplary embodiment, pouring the abrasive medium inside the vessel may include pouring a mixture of processing oil and at least one of boron carbide ($B_4C$) nanoparticles and silicon carbide (SiC) nanoparticles.

According to one or more exemplary embodiments, the present disclosure is directed to an apparatus for outer surface finishing of a workpiece. The exemplary apparatus may include a vessel. The vessel may include at least one baffle radially extending from an inner wall of the vessel toward the outer surface of the workpiece. The vessel may further include an abrasive medium poured between the inner wall of the vessel and the outer surface of the workpiece, where the abrasive medium is in contact with the outer surface of the workpiece. The exemplary apparatus may further include a first rotary actuator that may be coupled to the vessel and may be configured to drive a rotational movement of the vessel about the longitudinal axis of the workpiece in a first direction. The at least one baffle within the vessel may be configured to push the abrasive medium to assume a rotational movement around the longitudinal axis of the workpiece. The exemplary apparatus may further include a second rotary actuator that may be coupled to the workpiece and may be configured to drive a rotational movement of the workpiece within the vessel about the longitudinal axis of the workpiece in a second direction, where the second direction is opposite the first direction.

In an exemplary embodiment, the at least one baffle may include an outer edge adjacent the outer surface of the workpiece. The outer edge may be shaped such that a horizontal distance between the outer edge and the outer surface of the workpiece may be constant along a vertical length of the at least one baffle defining a working gap.

In an exemplary embodiment, the working gap may include a contact zone for the abrasive medium to rotate and impact the outer surface of the workpiece to perform surface finishing operation.

In an exemplary embodiment, the second rotary actuator may be coupled to the workpiece by a rotary shaft. The rotary shaft and the vessel may be placed coaxially along the longitudinal axis of the workpiece without any eccentricity.

In an exemplary embodiment, the first rotary actuator may be coupled to the vessel by a rotatable fixture. The rotatable fixture may correspond to a shape of the outer surface of the vessel and may be configured to grip and be rotatable with the vessel.

In an exemplary embodiment, the abrasive medium may include a mixture of a processing oil and nanoparticles inside the vessel. In an exemplary embodiment, the abrasive medium may include a mixture of processing oil and at least one of boron carbide ($B_4C$) nanoparticles and silicon carbide (SiC) nanoparticles.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1A:
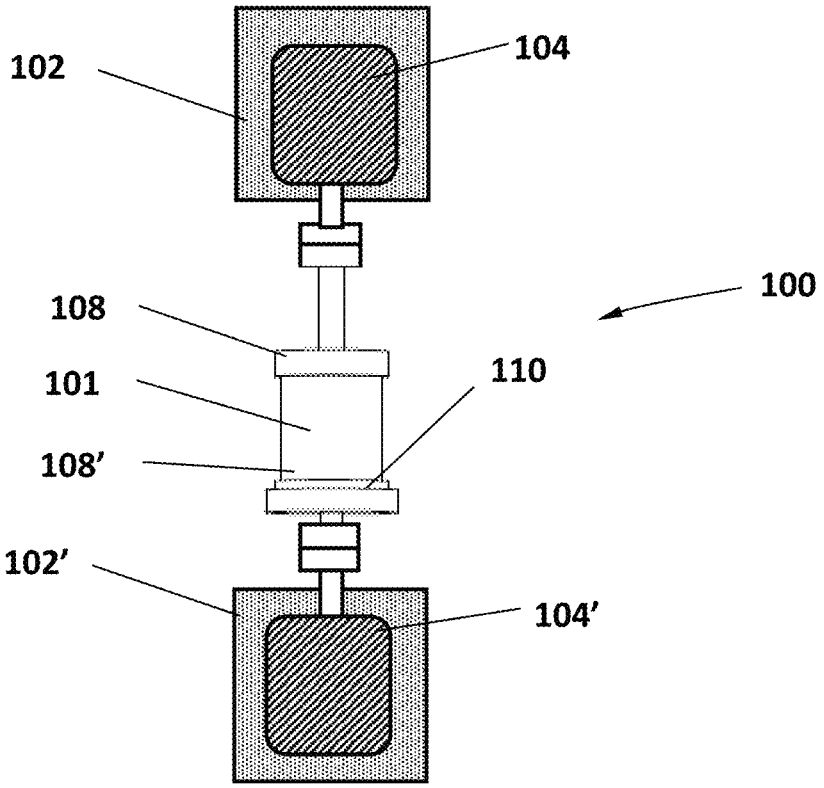
FIG. 1A shows a schematic view of a rotational abrasive finishing apparatus, consistent with one or more exemplary embodiments of the present disclosure.

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

For purposes of explanation, specific nomenclature is set forth to provide a thorough understanding of exemplary embodiment of the present disclosure. However, it will be apparent to those skilled in the art that these specific details are not required to practice exemplary embodiments of the present disclosure. Descriptions of specific applications are provided only as representative examples. Various modifications to the exemplary implementations may be readily apparent to one skilled in the art, and the general principles defined herein may be applied to other implementations and applications without departing from the principles of the exemplar embodiment of the present disclosure. Practices according to concepts disclosed by the present disclosure are not intended to be limited to the implementations shown, are to be accorded the widest possible scope consistent with the principles and features disclosed herein.

Disclosed methods and devices herein are directed to precise finishing of inner surface of a workpiece, where the inner surface defines an axially symmetric opening inside the workpiece. The method as described herein may include the steps of: first pouring an abrasive medium inside the opening; imposing a centrifugal force on the abrasive medium to accelerate the abrasive medium outwards from the center of rotation towards the inner surface of the opening, where the abrasive medium impacts the inner surface and performs the surface finishing with a micro/nanometric precision. In an implementation, the abrasive medium may be a medium of abrasive nanoparticles.

In an aspect, a stirrer may be used to urge a medium of abrasive nanoparticles that may be poured inside the opening of the workpiece to rotate about the longitudinal axis of the workpiece. This rotational movement may exert a centrifugal force on the abrasive nanoparticles and may accelerate them towards the inner surface of the opening inside the workpiece. The abrasive nanoparticles strike against the inner surface of the workpiece and perform the finishing act. The workpiece itself may rotate about the longitudinal axis of the workpiece in a direction opposite to that of the abrasive nanoparticles.

In some implementations, a rotary actuating mechanism, for example a combination of an electro motor and a gear-box system or a direct drive motor, may be utilized to drive the rotational movement of the stirrer. The stirrer may include a central shaft on which a number of radially extending blades may be attached. The stirrer may be disposed inside the opening and the abrasive medium may be poured between the blades of the stirrer. The rotary actuating mechanism may be coupled with the longitudinal axis of the stirrer and it may be configured to drive a rotational movement of the stirrer. The rotational movement of the stirrer forces the abrasive medium to rotate accordingly. Concurrently, another rotary actuator may be utilized to drive a rotational movement of the workpiece in a direction opposite that of the abrasive medium. To this end, in an implementation, the workpiece may be positioned inside a fixture and be rotatable therewith. The fixture may be coupled to the rotary actuating mechanism and the rotary actuating mechanism may drive the rotational movement of the fixture. In an implementation, the fixture may be designed according to the shape of the workpiece. According to some implementations, there may be a working gap between the stirrer blades and the inner surface of the workpiece.

The opposite direction rotation of the workpiece and the abrasive medium may lead to the abrasive nano-particles to rotate with higher relative velocity that may cause a faster, more precise and cost-efficient finishing. Since nanoparticles are used in the abrasive medium, the surface finishing may be performed with an accuracy in the order of nanometers. In order to facilitate the mounting of the workpiece, the apparatus may be designed in two upper and lower segments mounted vertically, in which the bottom segment is configured to locate the workpiece and the other one is also designed to hold and rotate the stirrer. The workpiece is rotatably mounted on the fixture, and the stirrer is mounted on the upper segment of the apparatus, and rotatable therewith.

Figure 1B:
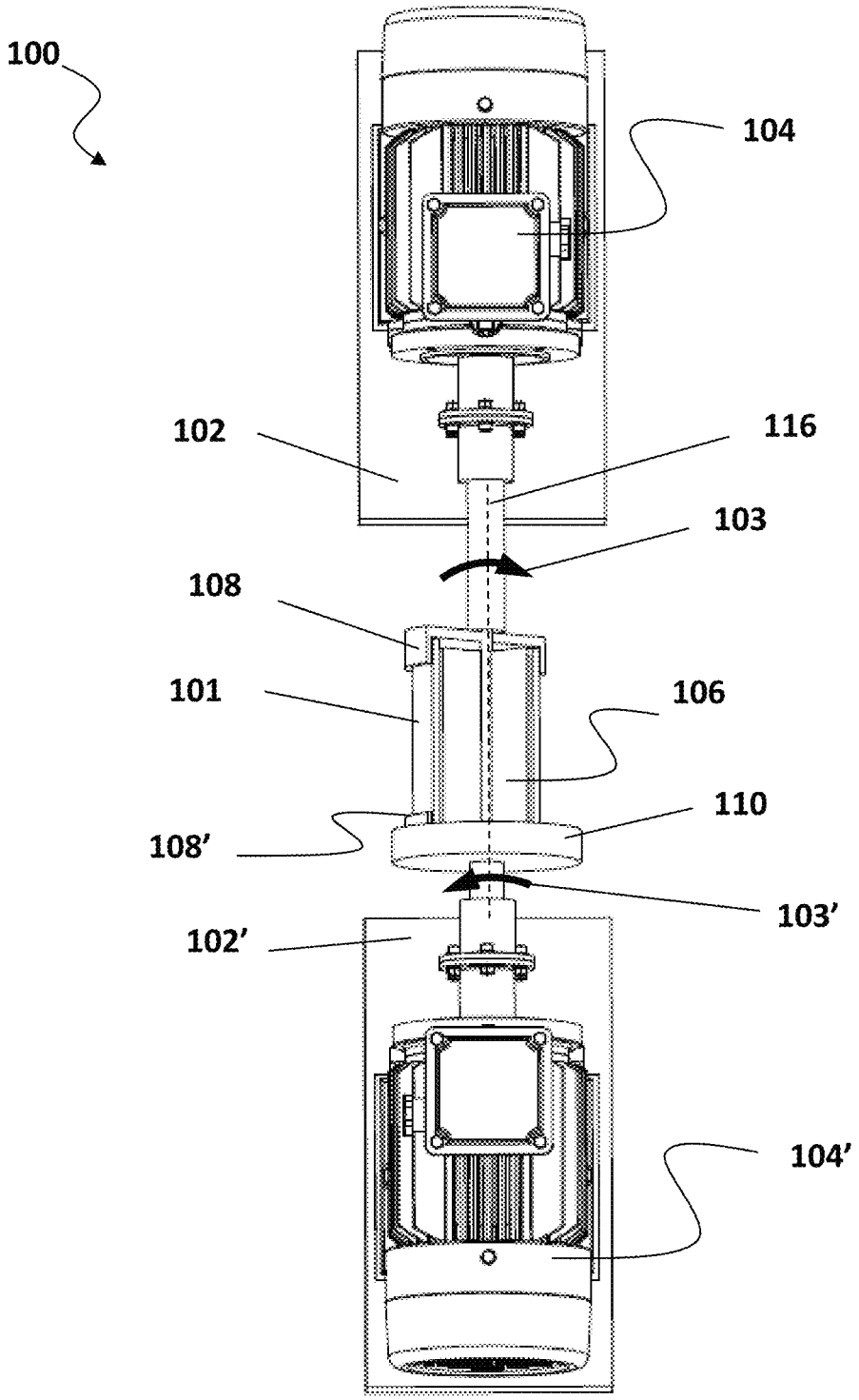
FIG. 1B illustrates a rotational abrasive finishing apparatus with a direct drive actuating mechanism, consistent with one or more exemplary embodiments of the present disclosure.

FIGS. 1A and 1B, show a schematic and top view of an exemplary implementation of the proposed apparatus according to one or more aspects of the present disclosure. Referring to FIGS. 1A and 1B, the exemplary rotational abrasive finishing apparatus 100 of the present disclosure may include: a mounting structure as a frame 102, which may be designed to provide mounting capability for other parts of the apparatus 100; two sets of rotary actuating mechanisms 104 and 104', which may be configured to serve as the power source along with the transmission system which transmits required power with a proper transmission ratio to the following members; a stirrer 106 which may be designed according to the geometrical specifications of the inside surface 101A of the workpiece 101 such as its size and shape and rotatably mounted on the upper segment of the frame 102, connected to the first rotary actuating mechanism 104, in order to provide the system with the rotational means for abrasive medium of nano-particles to rotate and deliver the finishing operation; two caps 108 and 108' which may be placed and fixed on the upper and lower sides of the workpiece (mounted on the lower side in case there is a requirement according to the shape of the workpiece), a fixture 110 that may be designed according to the outside geometry of the surface of the workpiece and coupled with the second rotary actuating mechanism 104', on which the workpiece 101 is rotatably mounted.

Referring to FIGS. 1A and 1B, the rotary actuating mechanisms 104 and 104', as the source of power and power transmission, may be configured to consist of a motor like an electric motor along with a power transmission system such as a pulley and belt system or a gear box system. Also, it is possible to use other forms of rotary actuating mechanisms 104 and 104' such as direct drive motors, which are mounted on the either sections of the frame 102 or 102', as shown in FIG. 1B. The power source provide the required power and the transmission system provide the following elements with the proper rotational speed. The power transmits to the stirrer 106 from the first rotary actuating mechanism 104 through the required coupling means, and the workpiece 101 also receives its required power from the second actuating mechanism 104' through the required coupling means, forcing them to rotate with their corresponding pre-determined rotational speeds, and setting the rotation of the first and second actuating mechanisms 104 and 104' to be in an opposite direction, the stirrer 106 and the workpiece 101 are also forced to rotate in the directions opposite to each other. Such a rotational movements in opposite directions leads to the rotation of medium of abrasive nano particles with higher rotational speed, providing a higher effective normal and tangential finishing forces and producing a polished surface with higher finish quality resulting in a time and cost efficient finishing process.

Figure 6:
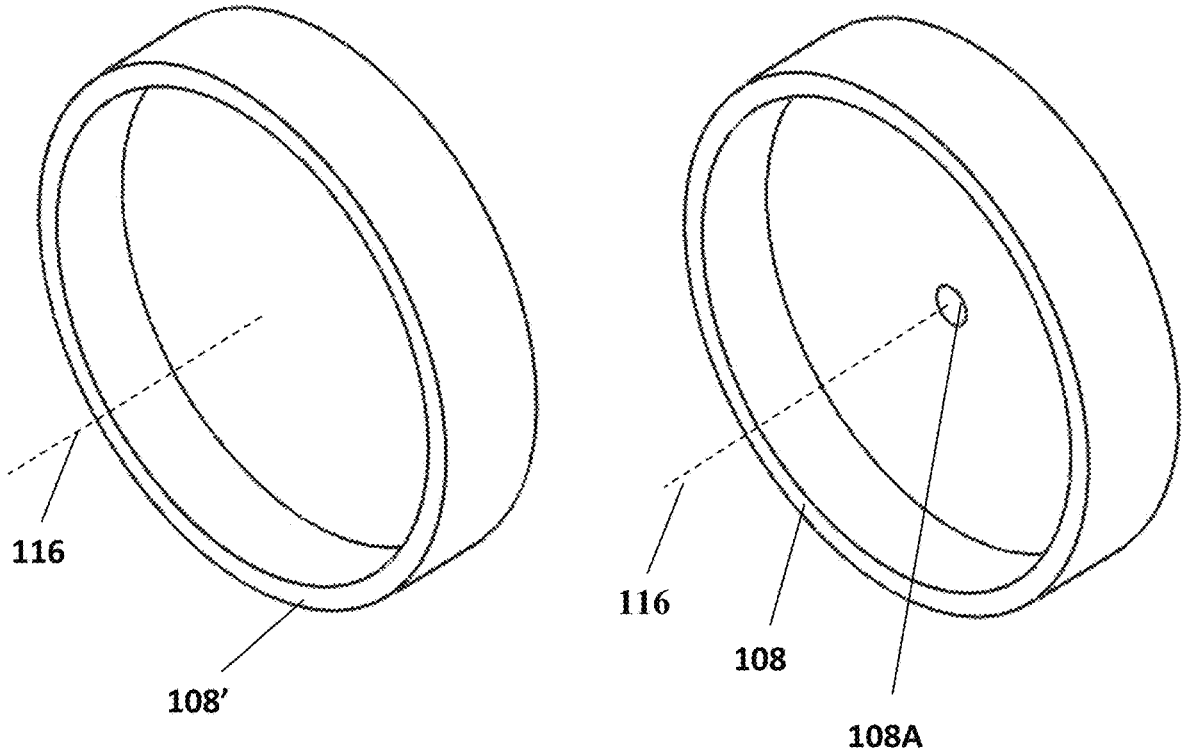
FIG. 6 illustrates a workpiece, consistent with one or more exemplary embodiments of the present disclosure.

Referring to FIGS. 1A and 1B, the frame 102 may be configured to consist of an upper segment 102 and a lower segment 102', which is configured to be capable of providing mounting means for the different parts including the rotary actuating mechanisms 104 and 104', which are located on the upper and lower segments of the frame 102, respectively, each one rotatably coupled with either the stirrer 106 at the upper side or the fixture 110 at the lower side Referring to FIGS. 1B, 4A and 6, first, workpiece 101 may be fixed on its fixture 110, and the fixture 110 may be coupled with the lower side rotary actuating mechanism (i.e., second rotary actuator) 104', then the stirrer 106 that may be coupled with the upper side actuating mechanism (i.e., first rotary actuator) 104 through the coupling means which all mounted on the upper side of the frame 102, placed inside the opening 101A, passing through the upper cap's opening 108A as shown in FIGS. 4A and 6, while the inner surface of the opening 101A may be filled with the medium of abrasive nano-particles 114. The stirrer 106 and the workpiece 101 may rotate as a result of the action of respective actuating mechanisms 104 and 104' with their specified rotational speeds, forcing the medium of abrasive particles 114 to rotate with higher velocity and deliver a higher finishing capability. The first and second actuating mechanisms 104 and 104' rotate in an opposite direction as shown by arrows 103 and 103' in FIG. 1B, forcing the stirrer 106 to rotate according to the direction shown by arrow 103 (shown also in FIGS. 2 and 4A as 115), which can be, for example clock-wise, and the workpiece 101 to rotate along the arrow 103' (shown also in FIGS. 2 and 4A as 115'), which can be, for example counter-clock wise.

It is also possible for the apparatus to design in other configurations. For example the apparatus may be configured in the horizontal direction, which forces the workpiece to place horizontally requiring higher centrifugal forces, which also necessitate a higher rotational speeds.

In an aspect, the higher speed of the rotational movements of nano-particles abrasive medium 114 may allow for the finishing process to be performed more efficiently and increases material removal rate and surface quality, compared with other nano-finishing methods, in which the workpiece has no motion.

Figure 2:
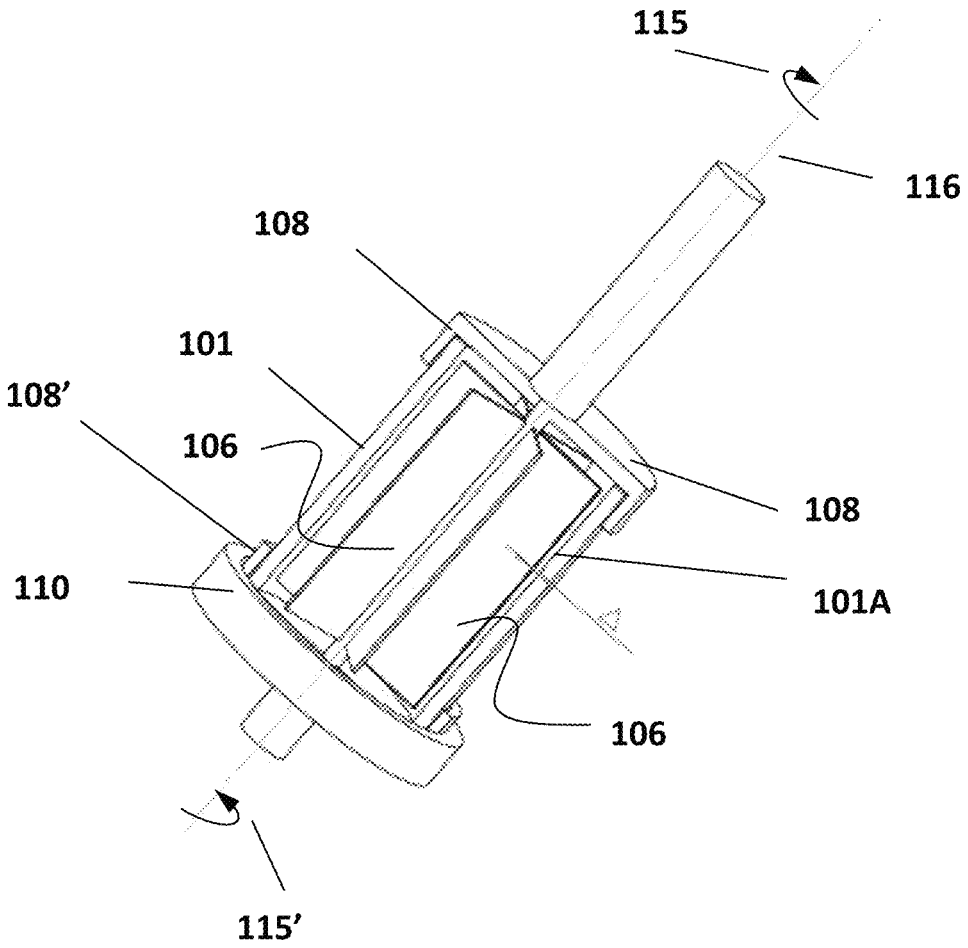
FIG. 2 illustrates a perspective view of a stirrer inside a workpiece along with its respective caps and fixture, consistent with one or more exemplary embodiments of the present disclosure.
Figure 3A:
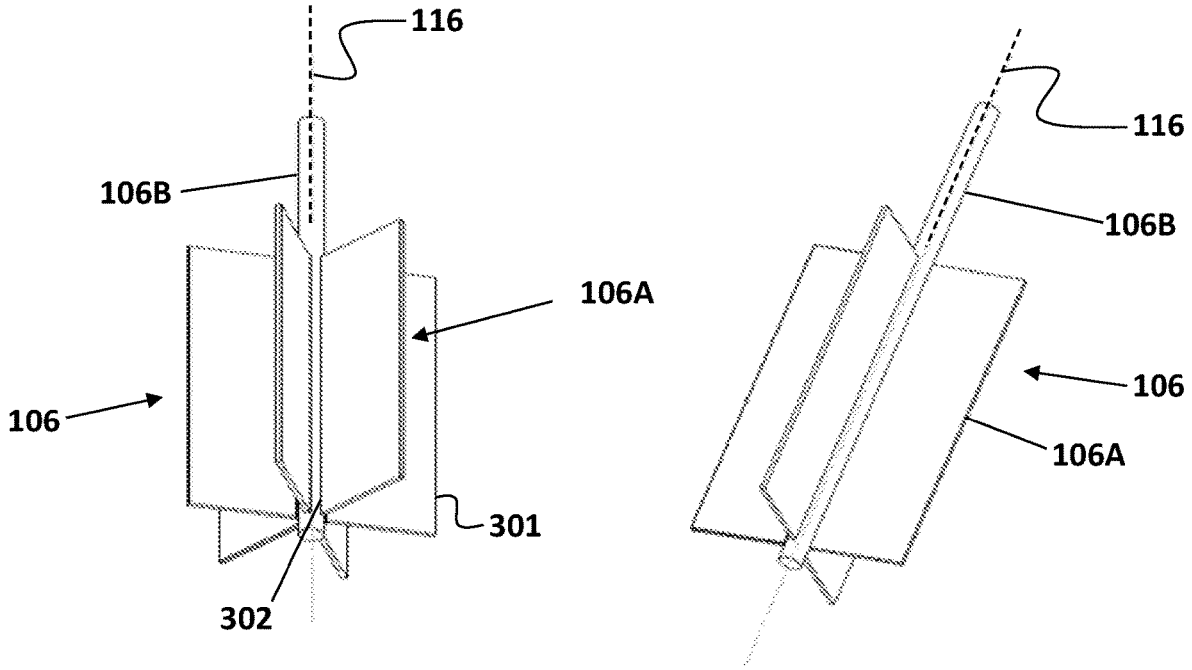
FIG. 3A shows a perspective view of two exemplary rotating stirrers with 4 and 6 rectangular blades, consistent with one or more exemplary embodiments of the present disclosure.
Figure 3B:
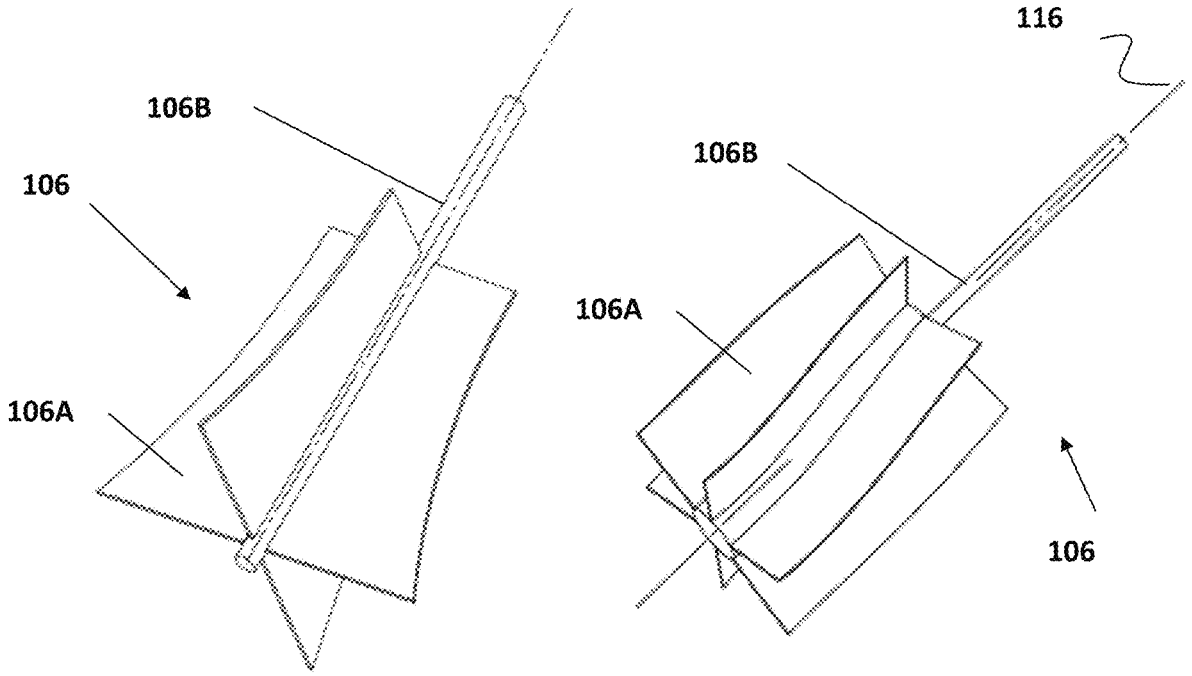
FIG. 3B shows a perspective view of two exemplary rotating stirrers with different shapes of the blades' profiles, consistent with one or more exemplary embodiments of the present disclosure.

FIGS. 3A and 3B show some of the different possible example implementations of the stirrer 106. Referring to FIGS. 3A and 3B the stirrer may include a central shaft 106B on which a plurality of radially extended blades 106A may be mounted. Each blade 106A may have a proximal edge 302 that may be attached to the central shaft 106B and a distal end 301 that may be configured to have a shape such that the horizontal distance between the distal edge 301 and the inner surface of the opening (designated as Δ in FIG. 2) is constant along the vertical length of the blade 106A. The central shaft 106B may be coaxially coupled with the output shaft of the first actuating mechanism 104 and rotatable therewith. The blades 106A may be disposed inside the opening 101A. The blades 106A may be designed according to the shape of the opening 101A, shown in FIG. 4A. Therefore the length, width, size, geometry and angles of blades 106A may be adjustable according to the diameter and geometry of the workpiece. The 4-bladed and 6-bladed stirrers are shown in FIG. 3A as example implementations of the stirrer 106, while other number of blades are also possible. The blades may have different profiles, such as rectangular profile as shown in FIG. 3A, while other profile shapes are also shown in FIG. 3B. The number of blades 106A, their geometries and respective angles are some of the factors which may affect the quality of finishing operation.

Referring to FIG. 2, there is a working gap, shown here as A, between the stirrer 106 and the inside wall of the workpiece 101A, which may be filled with the medium of abrasive nano-particles 114 and provides the required space for the finishing process to be performed through the abrasive contacts of the rotating nano-particles and the surface's atoms or molecules. Therefore there isn't any direct contact between the stirring blades 106A and the workpiece 101 compared with the traditional finishing techniques like grinding, honing and lapping, where there is a direct contact between tool tip and workpiece. Therefore, no abrasive heat is generated and there is no need for conventional cooling techniques used in traditional finishing processes. The stirrer 106 may rotate around the longitudinal axis 116 in the direction shown by arrow 115, while the workpiece 101, rotatably mounted on its designated fixture 110, may also rotate around the same axis 116 in an opposite direction shown by arrow 115'. All the elements shown in FIG. 2, including workpiece 101, caps 108 and 108', stirrer 106 and fixture 110 should be configured to be mounted concentrically around the longitudinal axis 116 and no eccentricity is allowed.

The stirrer 106 is not limited in terms of material, and can be made out of metal, plastic, wood and so on, which can be considered as an advantage, resulting in reduced manufacturing cost, while some of limitations of the other nano-finishing procedures can be eliminated such as lower material removal rate, being a time-consuming process and limitations associated with pressure, current and voltage and so on. In addition, the possibility of employing different stirrings with different geometries and sizes can eliminate limitations associated with finishing of some of special parts with cavities and large-diameter parts.

Referring to FIGS. 4A and 6, two caps 108 and 108' may be designed and configured to retain the medium inside the workpiece 101 space during the finishing process. The upper cap 108 may be designed to have a central opening 108A, as shown in FIG. 6, through which the longitudinal axis 116 passes, shown in FIG. 4A. These caps 108 and 108' may be mounted concentrically around the longitudinal axis 116. The use of these caps can save the amount of required medium and its cost, compared with other nano-finishing methods.

Referring to FIGS. 4A and 4B, the abrasive nanoparticles may be configured to be a mixture composed of abrasive particles having dimensions in the order of nanometer along with a processing oil which can be mixed with particles and hold them in the mixture, according to one implementation. The nano-particles content and type along with the medium's viscosity affect the quality of this finishing process. The particles can be made of nanometer-sized abrasive particles such as silicon carbide (SiC), boron carbide ($B_4C$), diamond and so on.

Figure 5A:
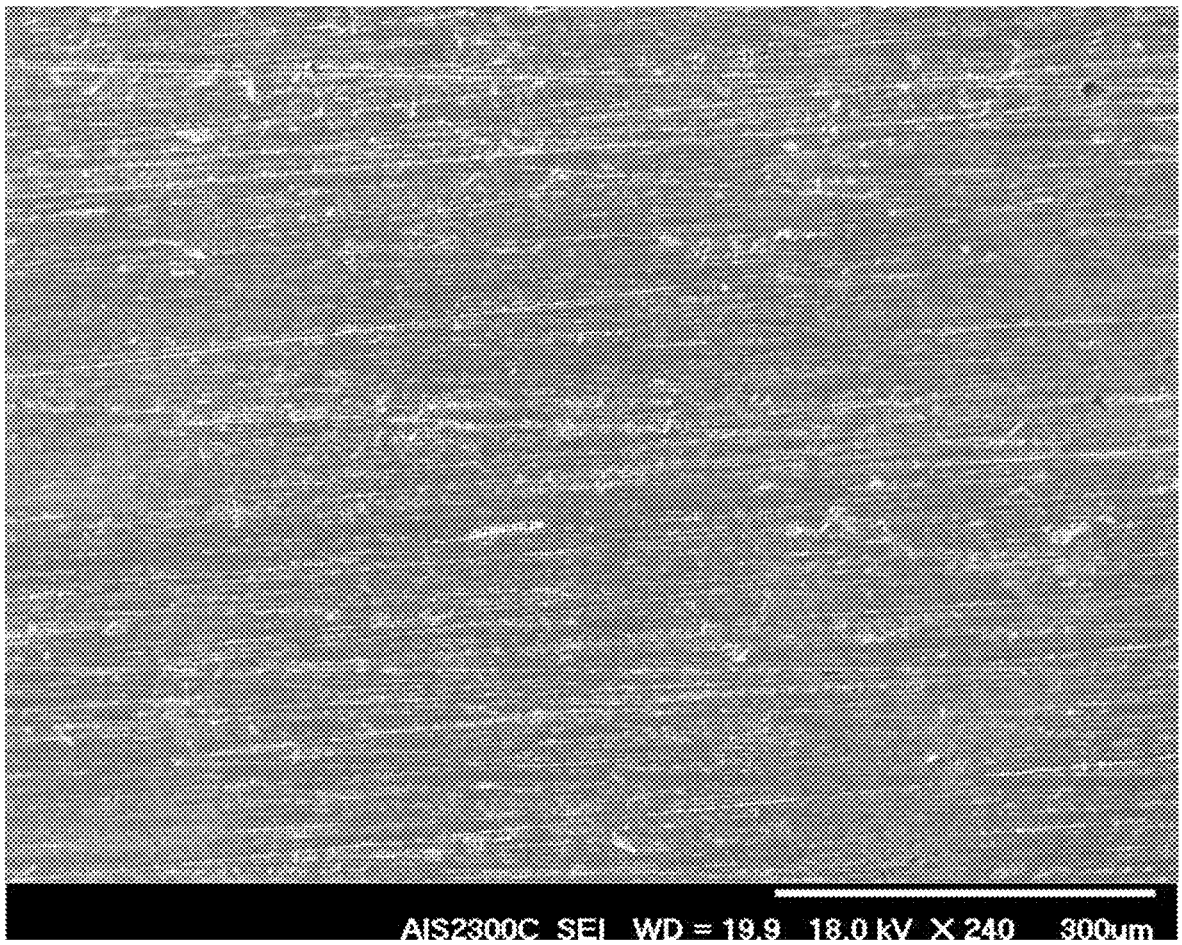
FIG. 5A illustrates a scanning electron microscope (SEM) image of an inner surface of a workpiece before applying a finishing process, consistent with one or more exemplary embodiments of the present disclosure.
Figure 5B:
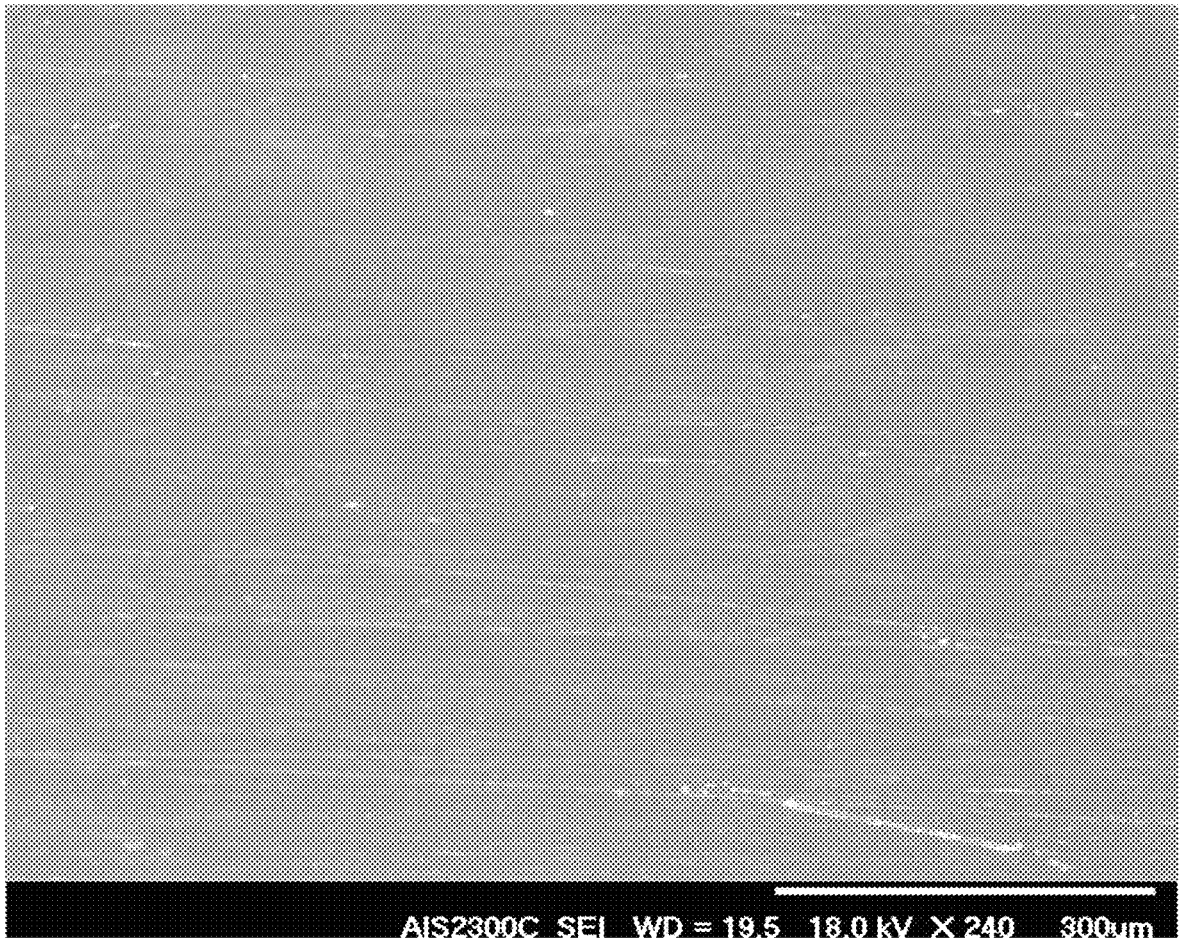
FIG. 5B illustrates an SEM image of an inner surface of a workpiece after applying a finishing process, consistent with one or more exemplary embodiments of the present disclosure.

FIGS. 5A and 5B show two SEM images of the surface of the workpiece before and after employing the current rotational abrasive finishing process respectively. Referring to FIG. 5A, the workpiece 101 inside roughness has been around $R_a$=0.283 micrometer before using the current rotational abrasive finishing method, while it is obtained to be around $R_a$=0.088 micrometer after applying this method, using the disclosed apparatus, referring to FIG. 5B, which clearly indicate the effect of applying this rotational finishing method and its associated apparatus.

Disclosed methods and devices herein are further directed to precise finishing of an outer surface of a workpiece. The exemplary method may include placing the workpiece inside a vessel and then filling an internal volume of the vessel between an inner wall of the vessel and the outer surface of the workpiece with an abrasive medium. The vessel may include at least one radially extended baffle that may extend from the inner wall of the vessel toward the outer surface of the workpiece. The exemplary method may further include rotating the abrasive medium with respect to the outer surface of the workpiece such that the abrasive medium may impact the outer surface of the workpiece and perform the finishing process. The abrasive medium may be rotated by rotating the vessel with respect to the workpiece about the longitudinal axis of the workpiece, where the at least one radially extended baffle may push the abrasive medium along a rotational path about the longitudinal axis of the workpiece. The exemplary method may further include concurrently rotating the workpiece within the vessel about the longitudinal axis in an opposite direction to help increase the impact of the abrasive medium on the outer surface of the workpiece.

Figure 7A:
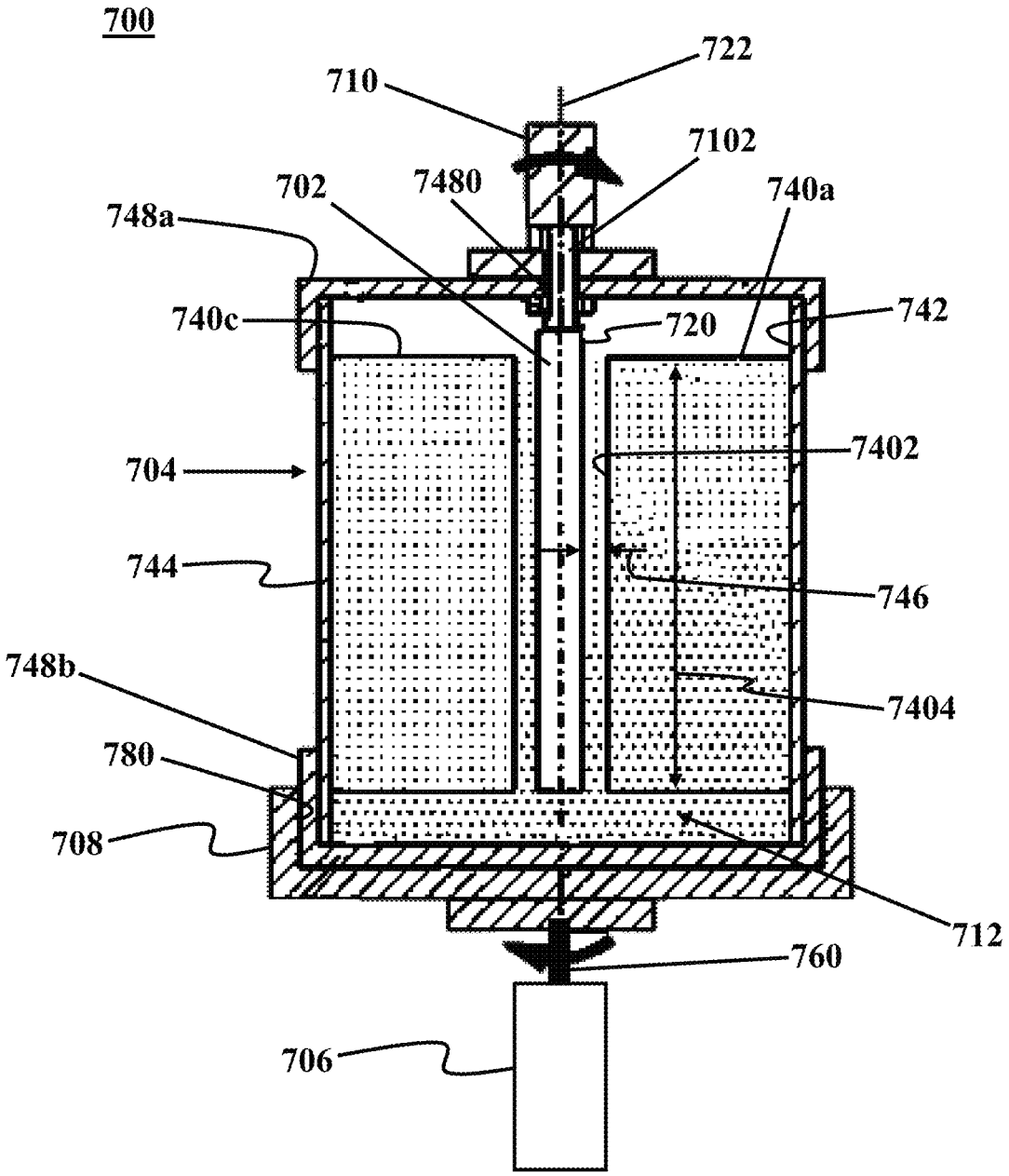
FIG. 7A illustrates a sectional side-view of an apparatus for outer-surface finishing of a workpiece, consistent with one or more exemplary embodiments of the present disclosure.
Figure 7B:
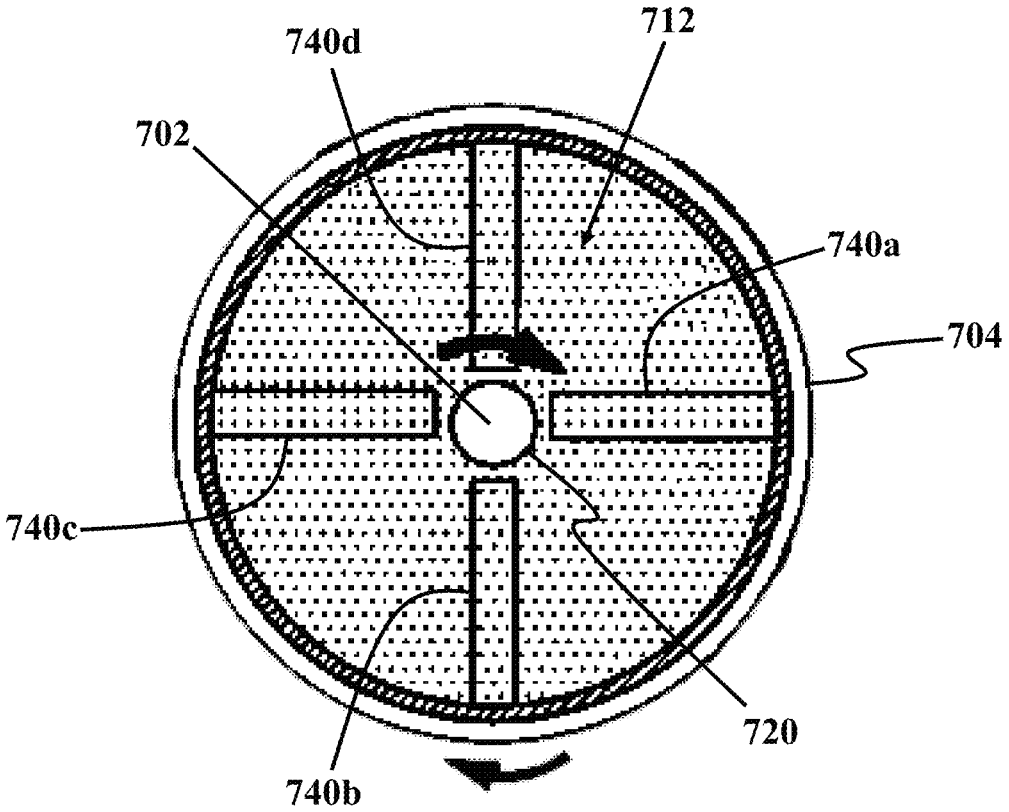
FIG. 7B illustrates a sectional top-view of an apparatus for outer-surface finishing of workpiece, consistent with one or more exemplary embodiments of the present disclosure.
Figure 7C:
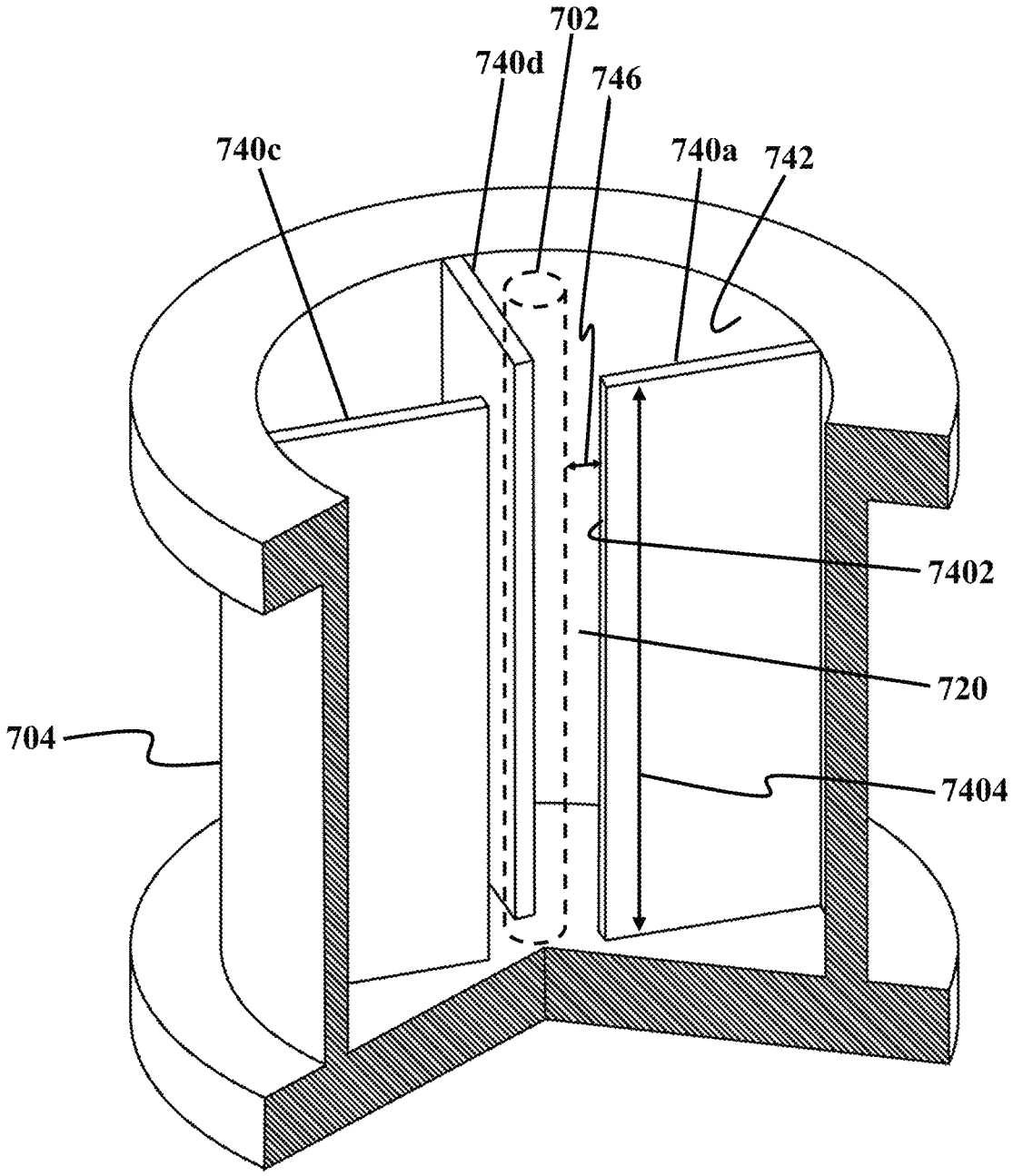
FIG. 7C illustrates a sectional perspective view of a vessel encompassing a workpiece, consistent with one or more exemplary embodiments of the present disclosure.

FIG. 7A illustrates a sectional side-view of an apparatus 700 for outer-surface finishing of a workpiece 702, consistent with one or more exemplary embodiments of the present disclosure. FIG. 7B illustrates a sectional top-view of apparatus 700 for outer-surface finishing of workpiece 702, consistent with one or more exemplary embodiments of the present disclosure. FIG. 7C illustrates a sectional perspective view of a vessel 704 encompassing workpiece 702, consistent with one or more exemplary embodiments of the present disclosure.

Referring to FIGS. 7A-7C, in an exemplary embodiment, apparatus 700 may include vessel 704 that may be a cylindrical enclosure that may encompass workpiece 702. Workpiece 702 may be coaxially placed inside vessel 704 such that a longitudinal axis 722 of workpiece 702 may be similar to a longitudinal axis of vessel 704. In an exemplary embodiment, an outer surface 720 of workpiece 702 may be axially symmetrical around longitudinal axis 722 of workpiece 702.

In an exemplary embodiment, vessel 704 may include one or more baffles, such as baffles 740*a-d* that may be integrated with or attached to an inner wall 742 of vessel 704. Each baffle, such as baffle 740*a* may be a panel that may radially extend from inner wall 742 toward an outer surface 720 of workpiece 702. In an exemplary embodiment, an outer edge of each baffle may be placed adjacent outer surface 720 with a horizontal distance between the outer edge and outer surface 720 being constant along a vertical length of each baffle. For example, an outer edge 7402 of baffle 740*a* may be adjacent outer surface 720 with a horizontal distance 746 between outer edge 7402 and outer surface 720 being constant along a vertical length 7404 of baffle 740*a*.

Figure 8:
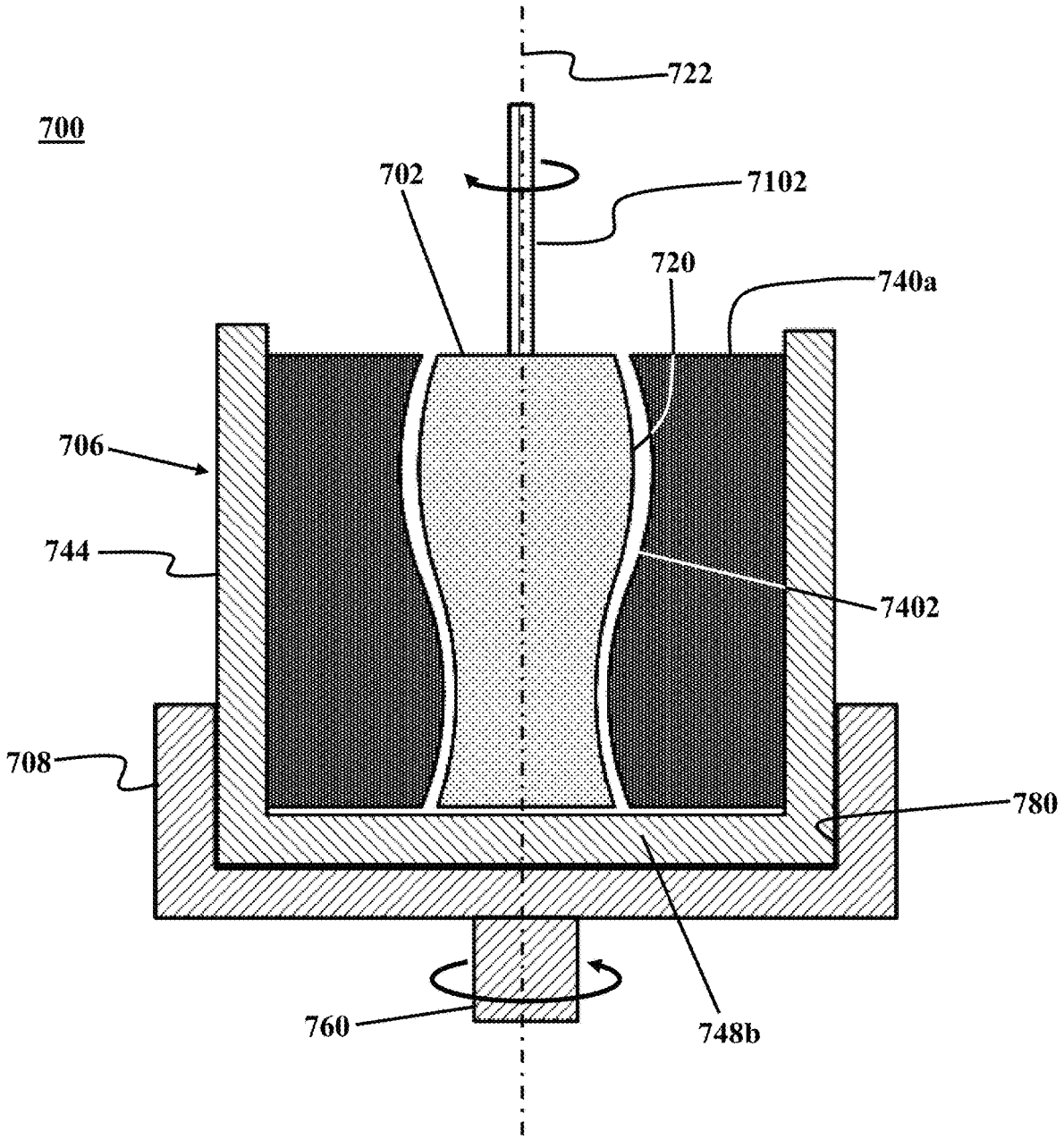
FIG. 8 illustrates a schematic sectional side-view of an apparatus, consistent with one or more exemplary embodiments of the present disclosure.

FIG. 8 illustrates a schematic sectional side-view of apparatus 700, consistent with one or more exemplary embodiments of the present disclosure. In an exemplary embodiment, outer surface 720 of workpiece 702 may have different profiles. As used herein, profile may refer to a shape of outer surface 720 when viewed from the side.

Referring to FIG. 8, in an exemplary embodiment, outer surface 720 may have a curved profile and the outer edges of the baffles may be shaped such that the shapes of the outer edges of the baffles adjacent outer surface 720 may conform to the curved profile of outer surface 720. For example, the shape of outer edge 7402 of baffle 740*a* may conform to the curved profile of outer surface 720 and in other words, a horizontal distance between outer edge 7402 and outer surface 720 may be constant along vertical length 7404 of baffle 740*a*.

Figure 4:
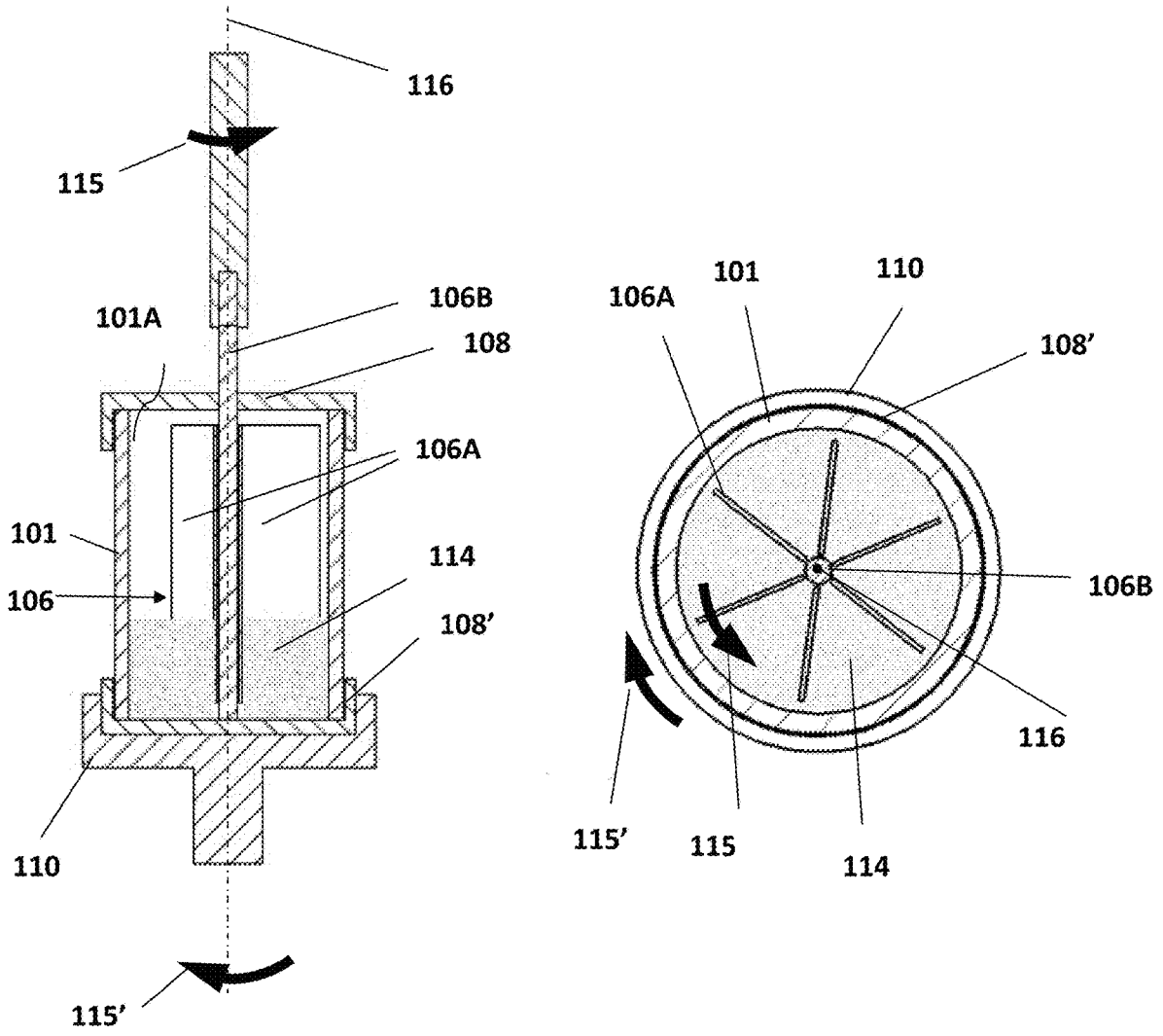
FIG. 4 illustrates two sectional views of an exemplary stirrer inside a workpiece filled with an abrasive nanoparticles medium, consistent with one or more exemplary embodiments of the present disclosure.

Referring to FIG. 7A, in an exemplary embodiment, apparatus 700 may further include a first rotary actuator 706 that may be coupled to vessel 704 via a rotatable fixture 708 similar to fixture 110 of FIG. 4. In an exemplary embodiment, rotatable fixture 708 may be a support member with a recessed portion 780 shaped and sized to enclose and grip a lower portion of vessel 704 such that vessel 704 may be rotatable with rotatable fixture 708.

In an exemplary embodiment, vessel 704 may include a cylindrical body 744 with an upper end cap 748*a* and a lower end cap 748*b* and rotatable fixture 708 may receive and tightly grip lower end cap 748*b* of vessel 704.

Referring to FIG. 8, in an exemplary embodiment, lower end cap 748*b* may be integrally formed with cylindrical body 744. Rotatable fixture 708 may be have a circular shape, when viewed from the top, that may be concentric with circular lower end cap 748*b* but with a larger diameter. Recessed portion 780 may have a circular shape that may be concentric with lower end cap 748*b* and slightly larger than lower end cap 748*b* such that lower end cap 748*b* may be snuggly fit within circular recessed portion 780.

Referring to FIGS. 7A and 8, in an exemplary embodiment, first rotary actuator 706 may be coupled to rotatable fixture 708 via a first rotary shaft 760. First rotary actuator 706 may be configured to drive a rotational movement of rotatable fixture 708 about longitudinal axis 722 of workpiece 702 in a first direction and this rotational movement may be transferred to vessel 704 by rotatable fixture 708.

In an exemplary embodiment, apparatus 700 may further include a second rotary actuator 710 that may be coupled to workpiece 702 via a second rotatable shaft 7102. Second rotary actuator 710 may be configured to drive a rotational movement of workpiece 702 about longitudinal axis 722 of workpiece 702 in a second direction. In an exemplary embodiment, vessel 704 and workpiece 702 may be rotated in opposite directions, in other words, the first direction may be clockwise or counterclockwise and the second direction may be opposite the first direction. In an exemplary embodiment, upper end cap 748*a* may include a central hole 7480 that may be equipped with a baring unit, for second rotatable shaft 7102 to pass through.

Referring to FIGS. 7A and 7B, an abrasive medium 712 such as a mixture of a processing oil and nanoparticles may be poured into vessel 704 in order to fill an internal volume of vessel 704 between inner wall 742 and outer surface 720. In an exemplary embodiment, abrasive medium 712 may be a mixture of a processing oil and at least one of boron carbide ($B_4C$) nanoparticles and silicon carbide (SiC) nanoparticles.

In an exemplary embodiment, when first rotary actuator 706 rotates vessel 704 around longitudinal axis 722 in a first direction, baffles 740*a-d* may push or force abrasive medium 712 along a rotational path around longitudinal axis 722 in the first direction and this way, abrasive medium 712 may assume a rotational movement around longitudinal axis 722 in the first direction. This way, abrasive medium 712 may rotate around workpiece 702 and impact outer surface 720.

In an exemplary embodiment, while first rotary actuator 706 rotates vessel 704 around longitudinal axis 722 in a first direction, second rotary actuator 710 may rotate workpiece 702 around longitudinal axis 722 in a second direction. In exemplary embodiments, such rotational movements of abrasive medium 712 in the first direction and workpiece 702 in the second opposite direction may allow for an efficient impact of abrasive medium 712 on outer surface 720, and in turn, may allow for applying an efficient surface finishing process on outer surface 720.

EXAMPLE

In this example, an exemplary method for outer-surface finishing of a workpiece is implemented utilizing an exemplary apparatus for outer-surface finishing similar to apparatus 700 of FIGS. 7A and 8.

In this exemplary embodiment, a workpiece similar to workpiece 702, which was a cylindrical rod made of stainless steel was placed in an outer-surface finishing apparatus similar to apparatus 700. An abrasive medium similar to abrasive medium 712 that contained 50 wt. % of SiC and 50 wt. % of a processing oil was utilized for performing the finishing process on the workpiece. The workpiece was coupled to an actuating mechanism similar to second rotary actuator 710, which rotated the workpiece with a speed of approximately 500 rpm. A vessel of an apparatus that was similar to vessel 704, was coupled to an actuating mechanism similar to the first rotary actuator 706, which rotated the vessel with a speed of 1000 rpm in an opposite direction of the rotational movement of the workpiece. The finishing process under the above conditions was carried out for 10 minutes on the workpiece.

Figure 9A:
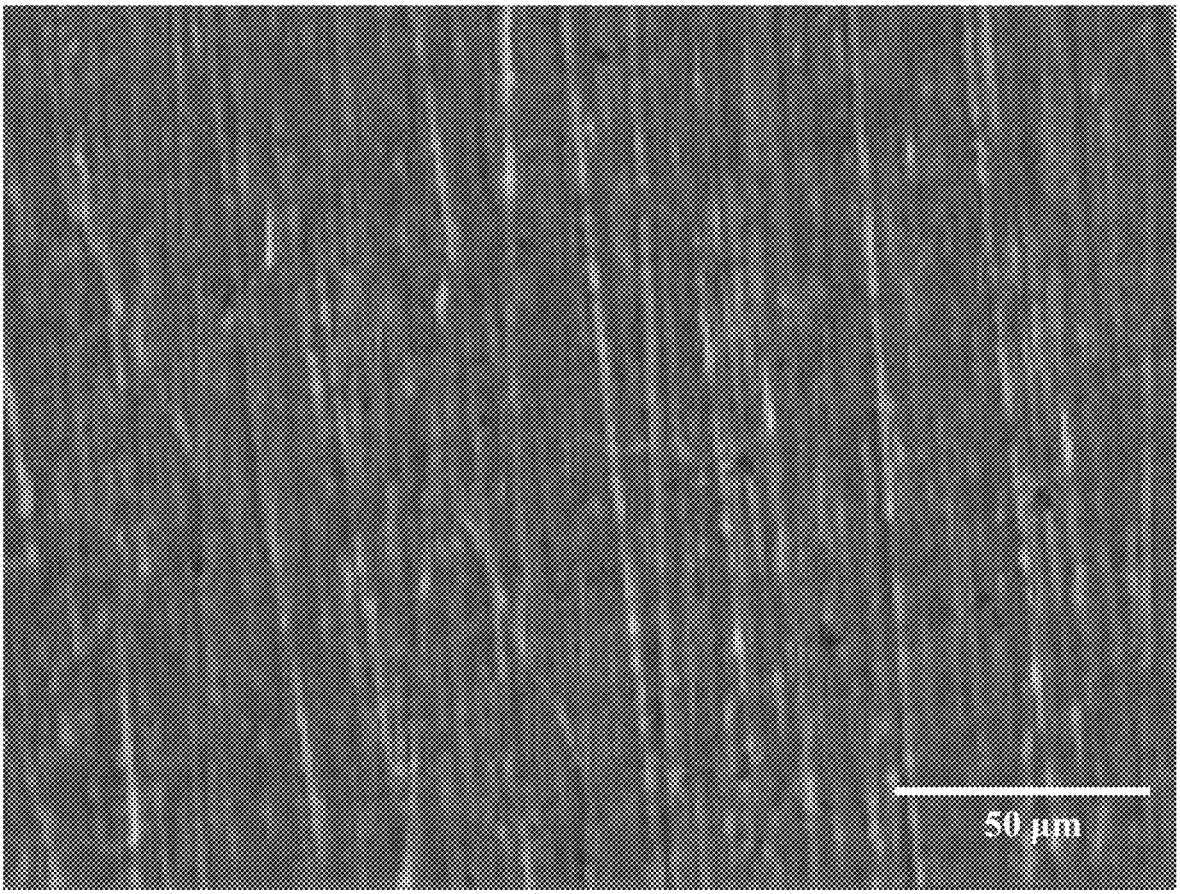
FIG. 9A is an SEM image of an outer surface of the workpiece before performing the finishing process, consistent with one or more exemplary embodiments of the present disclosure.
Figure 9B:
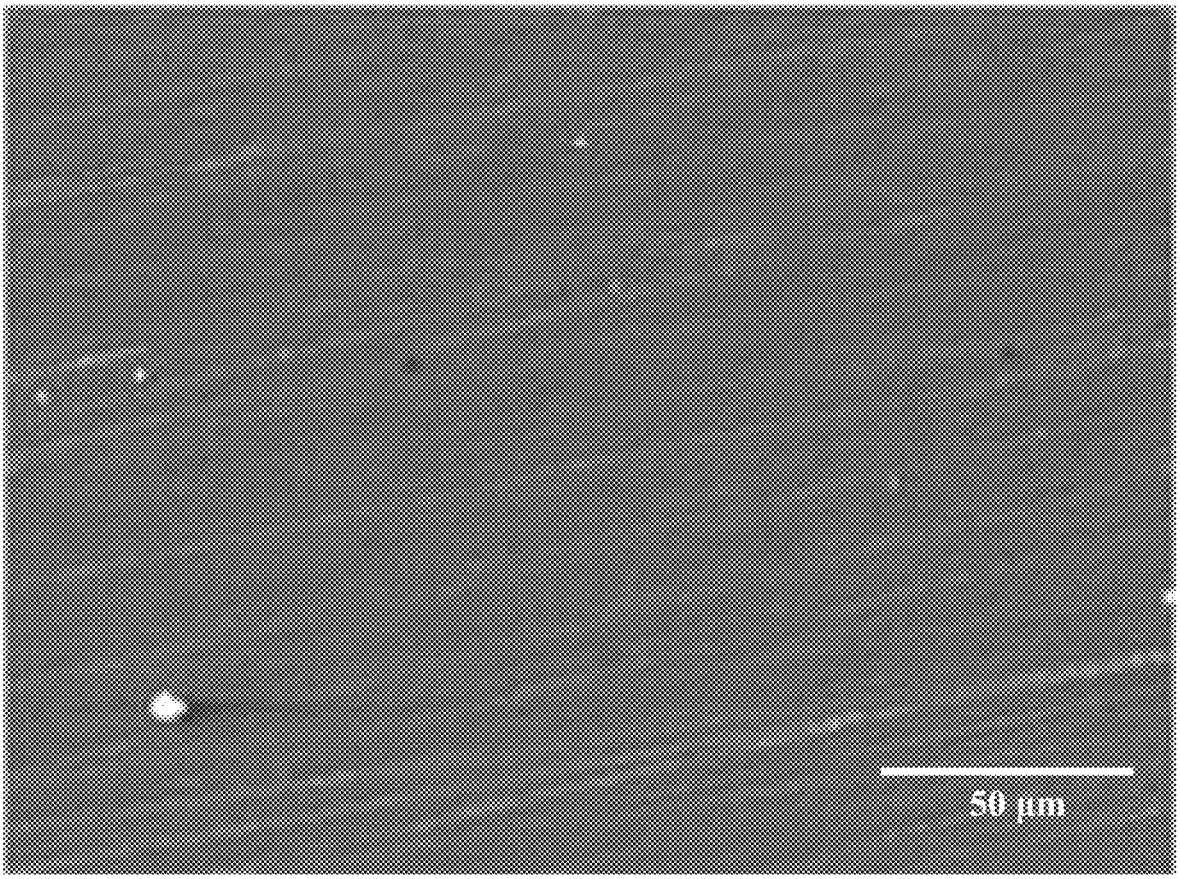
FIG. 9B is an SEM image of the outer surface of the workpiece after performing the finishing process, consistent with one or more exemplary embodiments of the present disclosure.

FIG. 9A is an SEM image of an outer surface of the workpiece before performing the finishing process, consistent with one or more exemplary embodiments of the present disclosure. FIG. 9B is an SEM image of the outer surface of the workpiece after performing the finishing process, consistent with one or more exemplary embodiments of the present disclosure. Referring to FIGS. 9A and 9B, a higher level of smoothness in the outer surface after performing the finishing process on the outer surface is evident compared to that of the outer surface before performing the finishing process. Quantitative measurements of the surface roughness before and after performing the finishing process showed that surface roughness decreased from 0.280 μm to 0.086 μm.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A method for outer-surface finishing of a workpiece, the method comprising:

coaxially placing the workpiece inside a vessel, the vessel comprising at least one baffle radially extending from an inner wall of the vessel toward the outer surface of the workpiece;

pouring an abrasive medium inside the vessel;

rotating the abrasive medium about the longitudinal axis in a first direction within the vessel relative to the outer surface of the workpiece by rotating the vessel about the longitudinal axis; and concurrently rotating the workpiece within the vessel about the longitudinal axis in a second direction, the second direction opposite the first direction.

2. The method according to claim 1, wherein coaxially placing the workpiece inside the vessel comprises placing the workpiece inside the vessel such that the longitudinal axis of the workpiece is similar to a longitudinal axis of the vessel.

3. The method according to claim 1, wherein pouring the abrasive medium inside the vessel comprises pouring the abrasive medium between the inner wall of the vessel and the outer surface of the workpiece, the abrasive medium contacting the outer surface of the workpiece.

4. The method according to claim 1, wherein coaxially placing the workpiece inside the vessel further comprises shaping an outer edge of the baffle adjacent the outer surface of the workpiece such that a shape of the outer edge of the baffle adjacent the outer surface of the workpiece conforms to a shape of the outer surface of the workpiece.

5. The method according to claim 1, wherein coaxially placing the workpiece inside the vessel further comprises placing the workpiece inside the vessel such that a horizontal distance between the outer edge of the baffle and the outer surface of the workpiece is constant along a vertical length of the outer edge of the baffle.

6. The method according to claim 1, wherein rotating the abrasive medium about the longitudinal axis within the vessel comprises forcing the abrasive medium to assume a rotational movement about the longitudinal axis by pushing the abrasive medium along a rotational path about the longitudinal axis utilizing the at least one baffle.

7. The method according to claim 1, wherein pouring the abrasive medium inside the vessel comprises pouring a mixture of a processing oil and nanoparticles inside the vessel.

8. The method according to claim 1, wherein pouring the abrasive medium inside the vessel comprises pouring a mixture of processing oil and at least one of boron carbide ($B_4C$) nanoparticles and silicon carbide (SiC) nanoparticles.

9. An apparatus for outer-surface finishing of a workpiece, the apparatus comprising:

a vessel comprising at least one baffle radially extending from an inner wall of the vessel toward the outer surface of the workpiece, the vessel further configured to contain an abrasive medium poured between the inner wall of the vessel and the outer surface of the workpiece;

a first rotary actuator coupled to the vessel and configured to drive a rotational movement of the vessel about the longitudinal axis of the workpiece in a first direction, the at least one baffle within the vessel configured to push the abrasive medium to assume a rotational movement around the longitudinal axis of the workpiece; and a second rotary actuator coupled to the workpiece and configured to drive a rotational movement of the workpiece within the vessel about the longitudinal axis of the workpiece in a second direction, the second direction opposite the first direction.

10. The apparatus according to claim 9, wherein the at least one baffle comprises an outer edge adjacent the outer surface of the workpiece, the outer edge shaped such that a horizontal distance between the outer edge and the outer surface of the workpiece is constant along a vertical length of the at least one baffle.

11. The apparatus according to claim 9, wherein the second rotary actuator is coupled to the workpiece by a rotary shaft, the rotary shaft and the vessel placed coaxially along the longitudinal axis of the workpiece without any eccentricity.

12. The apparatus according to claim 9, wherein the first rotary actuator is coupled to the vessel by a rotatable fixture, the rotatable fixture corresponding to a shape of the outer surface of the vessel and configured to grip and be rotatable with the vessel.

13. The apparatus according to claim 9, wherein the abrasive medium comprises a mixture of a processing oil and nanoparticles inside the vessel.

14. The apparatus according to claim 9, wherein the abrasive medium comprises a mixture of processing oil and at least one of boron carbide ($B_4C$) nanoparticles and silicon carbide (SiC) nanoparticles.

* * * * *